United States Patent [19]

Grange et al.

[11] 4,129,387

[45] Dec. 12, 1978

[54] APPARATUS FOR THE HOMOGENIZATION OF LIQUIDS

[75] Inventors: Arthur Grange; Stuart E. Booth, both of Shipley, England

[73] Assignee: Ultrasonics, Ltd., Shipley, England

[21] Appl. No.: 713,396

[22] Filed: Aug. 11, 1976

[51] Int. Cl.[2] ..... B01F 3/08; B01F 11/02

[52] U.S. Cl. ..... 366/119; 366/142; 366/174

[58] Field of Search ..... 259/1 R, 2, 4 R, DIG. 43, 259/DIG. 44, DIG. 30; 74/87

[56] References Cited

U.S. PATENT DOCUMENTS

| | | | |
|---|---|---|---|
| 2,077,228 | 4/1937 | DeBethune | 259/DIG. 30 |
| 3,176,964 | 4/1965 | Cottell | 259/1 R |
| 3,926,413 | 12/1975 | D'Urso | 259/4 R |

*Primary Examiner*—Harvey C. Hornsby
*Assistant Examiner*—Timothy F. Simone
*Attorney, Agent, or Firm*—Harrington A. Lackey

[57] ABSTRACT

An apparatus for homogenizing liquid such as emulsions and dispersions wherein the liquid is jetted from a nozzle onto a blade which is allowed to or cause to vibrate. To each side of the blade is a tuning member such as a plate which is adjustable towards and away from the blade thereby to constrain the passage of the liquid over the blade to the spaces at opposite sides of the blade and between the tuning plates and the blade. The position of the tuning plates depends upon the conditions of or in the liquid such as pressure, temperature and viscosity and the apparatus is set for optimum running depending upon these conditions.

6 Claims, 4 Drawing Figures

APPARATUS FOR THE HOMOGENIZATION OF LIQUIDS

BACKGROUND OF THE INVENTION

This invention relates to apparatus for the homogenisation of liquids such as emulsions and dispersions.

In a known form of apparatus of the type to which the invention relates, the liquid which has to be homogenised, which may be a mixture of liquids, is jetted towards the edge of a blade and over the blade. As the liquid passes over the blade it is mechanically worked upon whereby the homogenisation of the liquid takes place. It is not entirely clear exactly what happens to cause the homogenisation of the liquid impinging upon the blade, but in some cases the blade vibrates at ultrasonic frequency due to the impingement of the liquid and the vibration of the blade exercises an agitating effect on the liquid assisting in the homogenising process. Moreover, the vibration creates cavitation at the blade surface which also assists in the homogenisation process.

Because of the aforesaid vibration of the blade, such known apparatus is often referred to as a liquid whistle.

There is another belief that the vibration of the blade does not add significantly to the homogenisation of the liquid, but that it is the cavitation which is the principal factor in the effectiveness of the homogenising process.

In any event, in the known apparatus, the blade is located in a cavity from which the liquid, after striking the blade, is drained off and the known apparatus, whilst it has proved to be extremely useful, is somewhat limited as to its adjustability, especially when in use, and frequently the apparatus are not run at best efficiency for the liquids being worked upon.

There has been one proposal for increasing the range of adjustability of the apparatus and this proposal is that the cavity in which the blade is located is caused to be filled in use and the pressure of the liquid in the cavity is controlled to an optimum by restricting the flow of liquid downstream of the cavity. This proposal suggests that by controlling the pressure of the liquid in the cavity the range of efficiency of the apparatus is increased and better homogenisation over a wider range of liquid types is achieved, and also that the apparatus can be adjusted to adjust the cavity pressure and the apparatus performance, whilst the apparatus is in use.

SUMMARY OF THE INVENTION

The present invention also seeks to increase the performance of apparatus as described, but in a completely different manner from the proposal described above and also in a manner which provides an apparatus which is easy to adjust in use to suit varying conditions and changes in liquids being passed through the device.

Figure 1:
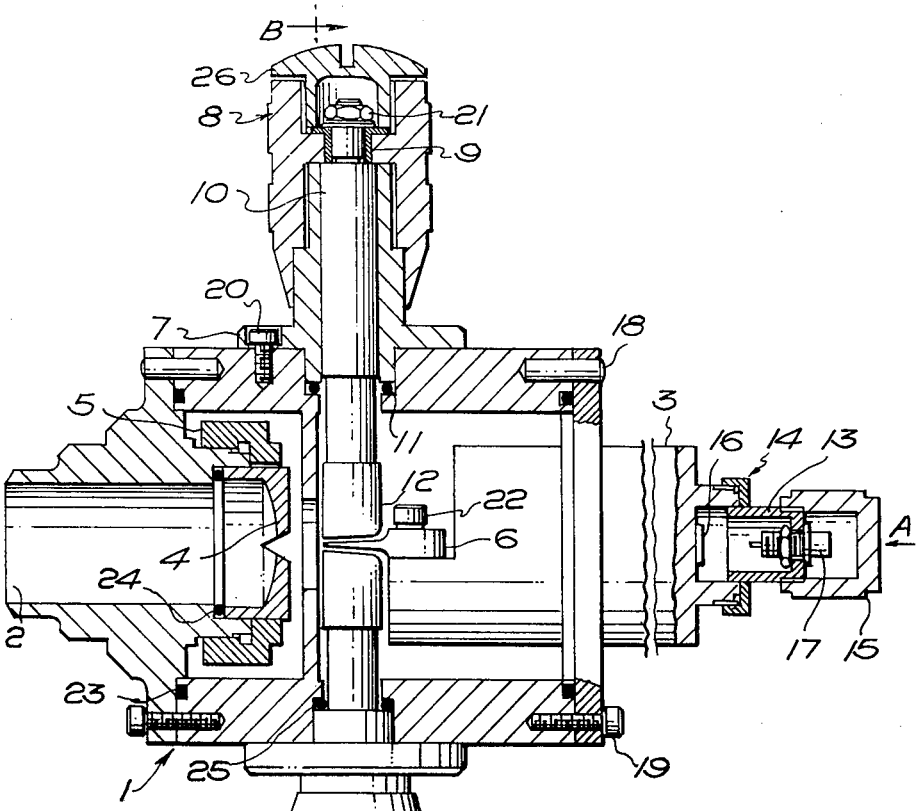
FIG. 1 is a sectional side elevation of the apparatus made in accordance with this invention, taken along the line C—C of FIG. 3.

Referring to the drawings, the apparatus according to the invention is shown in section in FIG. 1, and reference thereto will reveal that the apparatus comprises a generally cylindrical body 1 to one end of which is secured a jet holder body 2 and to the other end of which is secured a blade holder 3. The jet of the apparatus is indicated by reference numeral 4, and it will be seen that there is a sealing O-ring 24 between body 2 and jet 4. The jet aperture or orifice which lies on the axis of the body 1 is elongated to the form shown clearly in FIG. 3 so that when liquid under pressure is supplied to the jet 4 it issues from the orifice in the form of a narrow band. A cap 5 which is secured to body 2 serves to hold the jet 4 in position.

The blade means of the apparatus is indicated by numeral 6, and it will be seen that it is screwed to a ledge of the blade holder 3 (which is in the form of a resonant block). The blade means as shown clearly in FIG. 1 is a tapering cross-section towards the jet orifice and lies in axial alignment with such orifice so that the jet issuing therefrom will impinge directly upon the sharp edge of the blade (see also FIG. 4 in this connection).

It is to be noted that the body 1 has an internal partition which is provided with an elongated aperture. This aperture is in alignment with the jet orifice and lies between the jet orifice and the blade means 6.

There are two assemblies mounted symmetrically on the body 1 to opposite sides of the working faces of the blade means 6, each assembly comprising a gland plate 7 which is secured to the body by screws 20. Screwed to the gland plate 7 is a control knob 8 having a retaining cover 26 screwed thereto as shown clearly in FIG. 1. There is a bushing 9 inside the control knob 8 which engages a reduced diameter portion of a spindle 10 to the top end of which is screwed a nut 21 thereby trapping the bushing 9 between the nut and a larger diameter section of spindle 10 located slidably in the gland plate 7. The nut 21 is located in a recess in the retaining cover 26. The retaining cover 26 is provided with a screw slot on the head thereof whereby it may be turned by a screw-driver or like instrument.

Figure 3:
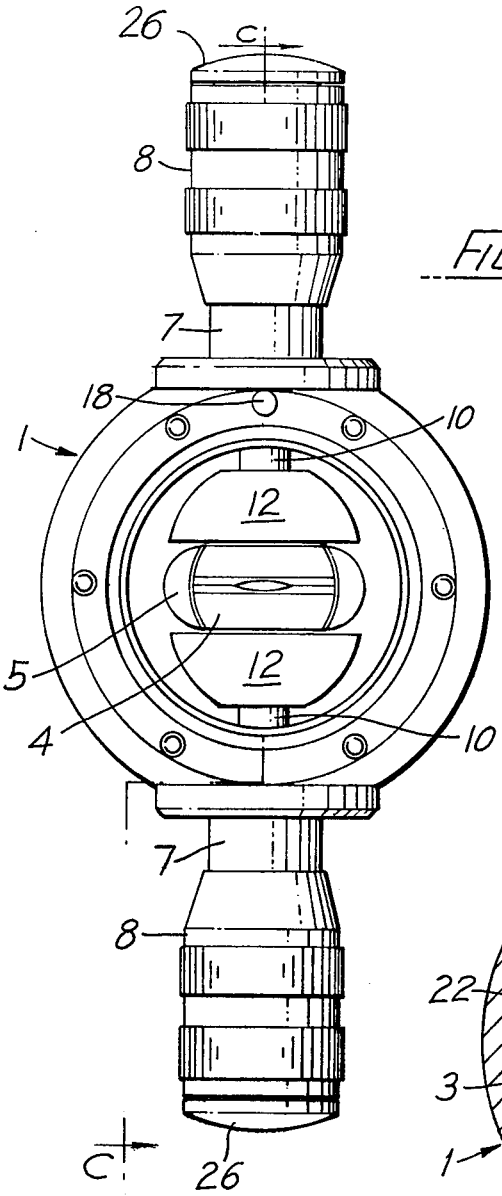
FIG. 3 is an end elevation of the apparatus taken in the direction of arrow A in FIG. 1, with the blade, blade mounting and end cover removed, and the turning plates retracted.
Figure 4:
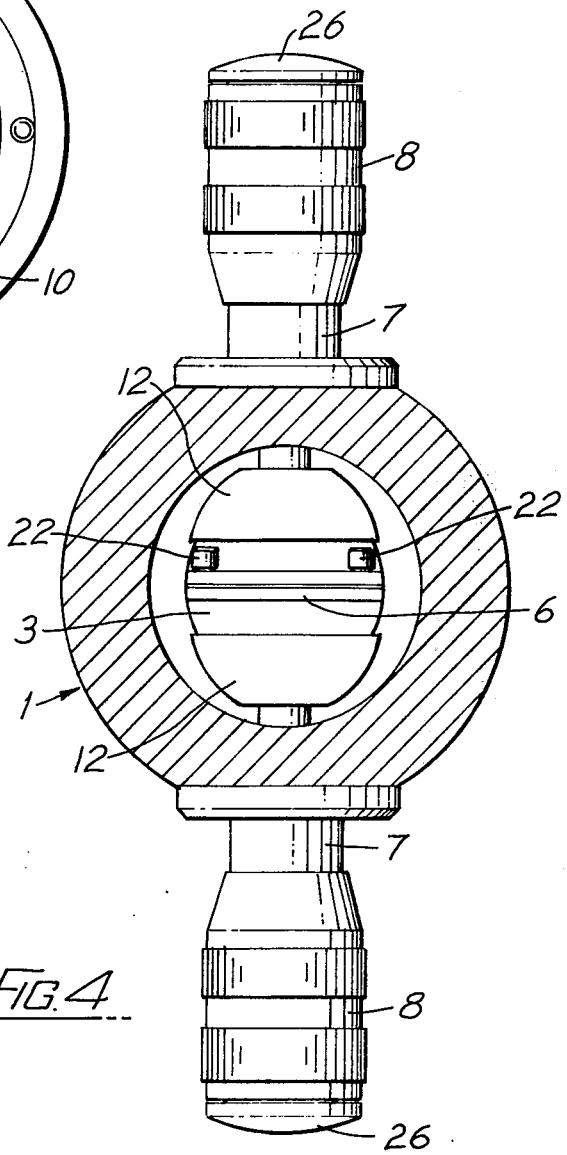
FIG. 4 is a sectional elevation taken along the line B—B of FIG. 1, the turning plates being retracted.

There is a sealing ring 11 located between the gland body 7 and the main body 1 and to the lower end of the spindle 10 is connected a tuning plate 12 of the configuration shown clearly in FIGS. 3 and 4. The surface of the tuning plate 12 which faces the blade 6 is in fact slightly angled relative to the axis of the apparatus by the same amount as is the opposite face of the blade means 6 so that the bottom face of the tuning plate 12 lies parallel to the opposite face of the blade means 6 and there can be created between the blade means 6 and such bottom face an even thickness space the width of which is adjustable respectively from zero to a maximum by turning of the control knob 8.

There are two similar assemblies as mentioned above, and the plates 12 are independently adjustable so that the respective sides of the blade means 6 can be tuned to differing extents. In a modification, it is possible to gang the two adjustment assemblies so that adjustment of one effects equal and opposite adjustment of the other. It is thought to be more preferable, however, to have the assemblies independently adjustable.

To the outer end of the block or blade holder 3 is attached a socket mounting 13, this being attached to the block 3 by mounting nut 14, and a cover 15 is attached to the socket mounting as shown. A piezo electric crystal 16 is attached to the block 3 as shown in order to sense the vibration thereof, and 17 represents a socket by which the vibration sensed by the piezo can be transmitted electrically to suitable instrumentation for measuring or displaying a representation of the vibration.

The block 3 is connected to the body 1 by means of screws 19 and additionally there is a location pin 18 to ensure that the block 3 is correctly positioned in relation to the tuning plates.

In the example illustrated, the blade means 6 is a single item of approximately the same length as the bottom edges of the tuning plates 12. It is possible to fabricate the plate means in a number of separate sections and to arrange these sections in alignment.

The use of the apparatus described is extremely simple. The liquid to be homogenised is passed through the body 2 to the jet 4 from whence it issues as a high speed and flattened jet impinging upon the blade means 6. The movement of the liquid over the blade means 6 probably will cause it to vibrate ultrasonically which vibrations can be sensed through the crystal 16 and the socket 17, and almost certainly there will be cavitation in the liquid at the surfaces of the blade means over which the liquid passes. The cavitation or the vibration or a combination of both results in the effective homogenisation of the liquid passing over the blade 6. The tuning plates 12 act to constrain the liquid to travel in even width gaps on each side of the blade means 6, and these tuning plates can be adjusted towards and away from the blade means 6 depending upon the liquid which is passing through the apparatus, in order always that the apparatus can operate at maximum efficiency. The constraining effect of these tuning plates has shown that the apparatus can be used much more effectively than if the tuning plates were completely removed or totally retracted as indicated in FIGS. 3 and 4. It is possible to tune both sides of the blade means differently by the independent adjustment of the tuning plate 12.

The block 3 is preferably secured to the body 1 in a nodal plane so that when the block is vibrating, this plane will be free from vibration and the crystal 16 will be located at a position in relation to the wave-length to give an accurate reflection of any vibration which is taking place at the blade means.

The block 3 in fact forms a resonant mounting to ensure that the blade will vibrate as this gives a means whereby the vibration can be sensed and measured as desired by the use of the crystal 16.

If the liquid supplied to the jet is from a source the pressure of which varies cyclicly, then almost certainly the resonant mount 3 will be caused to vibrate by the cyclic variations in the jet pressure.

Blade vibrations induced by the liquid flow is enhanced since the mounting of the blade on the resonant mass or block 3 results in negligible damping effects on the blade oscillations as compared with a vibratory member which is clamped to a fixed or non-resonant mounting.

In the example described, the tuning plate bottom surfaces lie parallel to the opposite blade surfaces. However, the volume and/or the shape of the space around the blade may be varied and the form or contour of the liquid jet itself can be controlled so that variations in forward pressure, viscosity and temperature can be compensated for to suit varying conditions of operation. Moreover, the use of tuning plates substantially ensures that the energy developed in the blade is contained in the area closely surrounding the blade and that substantially all the liquid passing from the jet orifice to the liquid outlet flows through this area.

The adjustable tuning devices or member may take forms other than plates and their shape and number may be commensurate with the form of the vibratory member. For example, three or more enclosing or screening devices may be used; two pairs of opposed plates such as the plates 12 in the drawing may be arranged to form almost an open-ended box with the plates constituting the four sides; or two substantially semi-cylindrical plates may be arranged to form in effect a split tube through which the liquid jet flows over the working surface of the vibratory member.

Provision may also be made for automatic adjustment of the tuning devices by using the output developed from the acoustic pressure sensor to actuate in a conventional manner one or more electric motors or other power means which move said tuning devices. This control system would then monitor the operation of the apparatus and adjust it to suit operating conditions and requirements as they vary.

Figure 2:
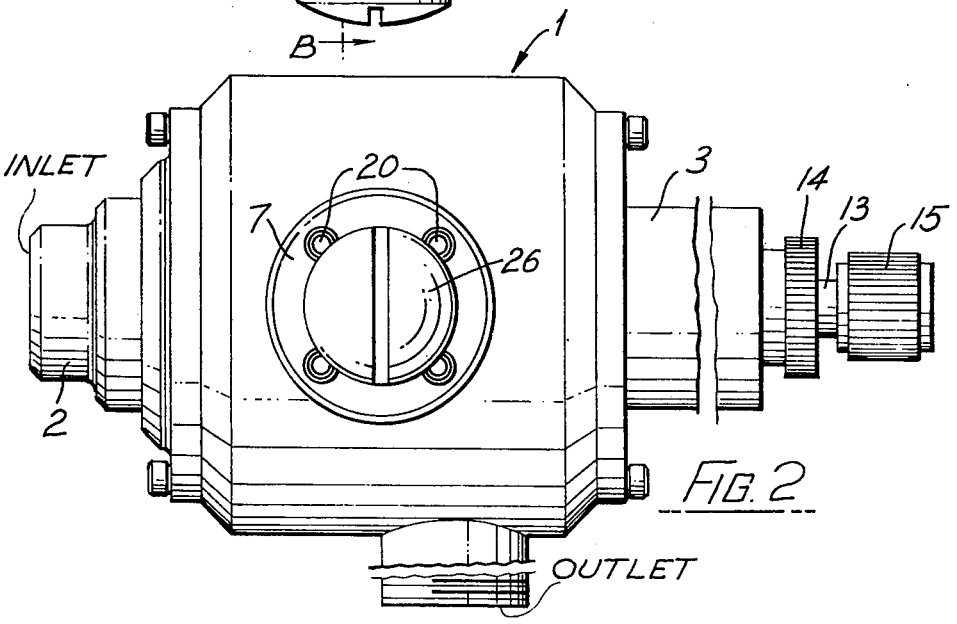
FIG. 2 is a plan view of the apparatus disclosed in FIG. 1.

The apparatus described is extremely useful for the homogenisation of liquid such as emulsions for producing synthetic filaments and fibres, dyestuffs, soup emulsions and other foodstuffs emulsions. The range of application is extremely wide, and apparatus such as that described has been known to handle up to as much as 1,000 gallons per hour. The liquid after passing through the device is effectively homogenised and it passes from the outlet which is shown in FIG. 2 only in condition ready for further processing. It should be noticed that it is not necessary to fill the interior of the body 1 completely as in the prior art arrangement described herein, although if desired the interior of the body 1 can run full.

We claim:

1. An apparatus for the ultrasonic homogenization of liquids, such as emulsions and dispersions, comprising:

(a) a body including a homogenization chamber having an inlet end and an outlet end, (b) jet means having an orifice in the inlet end portion of said chamber for forcing liquid through said orifice along a flow axis toward said outlet end, (c) blade means having opposite blade surfaces converging in a blade edge, (d) mounting means supporting said blade means in said homogenization chamber for non-rotary, vibratory movement and positioning said blade edge opposite said orifice and in aligment with the flow axis of liquid through said orifice, so that liquid flowing from said orifice impinges on said blade edge and passes over said opposite blade surfaces toward said outlet end, (e) at least one tuning member in said homogenization chamber having a tuning surface opposing at least one of said blade surfaces, (f) adjustment means on said body supporting said tuning member for relative movement of said tuning surface toward and away from said blade surface to contain the flow of liquid between said tuning member and said blade means.

2. The invention according to claim 1 further comprising at least two of said tuning members, each having a tuning surface so that one tuning surface opposes one of said blade surfaces and another tuning surface opposes the other of said blade surfaces, said adjustment means supporting each of said tuning members for relative movement toward and away from said corresponding blade surfaces.

3. The invention according to claim 2 in which each blade surface and its opposing tuning surface are spaced apart substantially uniformly to form even-width gaps on opposite sides of said blade means.

4. The invention according to claim 1 in which said mounting means is fixedly secured to said body in a nodal plane spaced from said blade means so that said blade means is located in an anti-nodal position.

5. The invention according to claim 4 in which said mounting means comprises resonant mounting block means having a face adjacent said blade means in said anti-nodal position and opposing said orifice, so that liquid flowing from said orifice impinges upon said face.

6. The invention according to claim 5 further comprising an acoustic pressure-sensitive device fixed to said resonant mounting block means externally of said chamber to detect the acoustic pressure in the liquid contained between said tuning member and said blade means.

* * * * *